US008844897B2

(12) United States Patent
Rundquist et al.

(10) Patent No.: US 8,844,897 B2
(45) Date of Patent: Sep. 30, 2014

(54) NIOBIUM AS A PROTECTIVE BARRIER IN MOLTEN METALS

(75) Inventors: Victor F. Rundquist, Carrollton, GA (US); Kevin S. Gill, Carrollton, GA (US)

(73) Assignee: Southwire Company, LLC, Carrollton, GA (US)

( * ) Notice: Subject to any disclaimer, the term of this patent is extended or adjusted under 35 U.S.C. 154(b) by 0 days.

(21) Appl. No.: 12/397,534

(22) Filed: Mar. 4, 2009

(65) Prior Publication Data

US 2009/0224443 A1 Sep. 10, 2009

Related U.S. Application Data

(60) Provisional application No. 61/033,807, filed on Mar. 5, 2008.

(51) Int. Cl.

| | |
|---|---|
| ***B22D 11/059*** | (2006.01) |
| ***B22C 3/00*** | (2006.01) |
| ***B22C 9/06*** | (2006.01) |
| ***B06B 3/00*** | (2006.01) |

(52) U.S. Cl.

CPC ..... *B06B 3/00* (2013.01); *B22D 11/059* (2013.01)

USPC ..... 249/114.1; 249/116; 249/134; 249/135; 164/122; 164/138; 164/411; 164/443; 164/459

(58) Field of Classification Search

USPC ..... 249/114.1, 115, 116, 134, 135; 106/38.2, 38.22, 38.9; 164/122, 138, 164/411, 443, DIG. 6, DIG. 15, 418, 459

See application file for complete search history.

(56) References Cited

U.S. PATENT DOCUMENTS

| | | | | | |
|---|---|---|---|---|---|
| 2,820,263 | A | | 1/1958 | Fruengel | |
| 3,162,908 | A | | 12/1964 | De Luca | |
| 3,177,084 | A | * | 4/1965 | Amstein | 428/408 |
| 3,193,889 | A | | 7/1965 | Lane et al. | |
| 3,286,312 | A | * | 11/1966 | Davis et al. | 249/134 |
| 3,434,823 | A | | 3/1969 | Adamec | |
| 3,459,255 | A | * | 8/1969 | Kolle | 164/443 |
| 3,495,104 | A | | 2/1970 | Burgo et al. | |
| 3,521,849 | A | * | 7/1970 | Voss | 249/135 |
| 3,633,898 | A | | 1/1972 | Josefsson et al. | |

(Continued)

FOREIGN PATENT DOCUMENTS

| | | | | |
|---|---|---|---|---|
| CN | 101435064 A | | 5/2009 | |
| DE | 2104843 | * | 8/1972 | B22C 3/00 |

(Continued)

OTHER PUBLICATIONS

Conduction; The Physic Hypertext book, 1998, pp. 1-3.*

(Continued)

*Primary Examiner* — Dimple Bodawala
(74) *Attorney, Agent, or Firm* — Merchant & Gould P.C.

(57) ABSTRACT

Devices may be in contact with molten metals such as copper, for example. The devices may include, but are not limited to, a die used for producing articles made from the molten metal, a sensor for determining an amount of a dissolved gas in the molten metal, or an ultrasonic device for reducing gas content (e.g., hydrogen) in the molten metal. Niobium may be used as a protective barrier for the devices when they are exposed to the molten metals.

10 Claims, 3 Drawing Sheets

(56) References Cited

U.S. PATENT DOCUMENTS

| | | | | | |
|---|---|---|---|---|---|
| 3,709,722 | A | * | 1/1973 | Corrigan et al. | 427/295 |
| 3,734,480 | A | * | 5/1973 | Zanis et al. | 266/275 |
| 3,794,102 | A | * | 2/1974 | Binder | 164/465 |
| 3,848,847 | A | * | 11/1974 | Komatsu et al. | 249/115 |
| 3,858,640 | A | | 1/1975 | Sifferlen | |
| 3,872,913 | A | * | 3/1975 | Lohikoski | 164/474 |
| 3,900,947 | A | * | 8/1975 | Diepers et al. | 29/599 |
| 3,973,750 | A | * | 8/1976 | Rabinovitch et al. | 249/114.1 |
| 3,990,498 | A | * | 11/1976 | Dompas et al. | 164/459 |
| 4,074,152 | A | | 2/1978 | Asai et al. | |
| 4,175,609 | A | * | 11/1979 | El Gammal et al. | 164/122.2 |
| 4,287,755 | A | | 9/1981 | Mansfield | |
| 4,316,734 | A | | 2/1982 | Spinosa et al. | |
| 4,426,244 | A | | 1/1984 | Wang | |
| 4,485,179 | A | * | 11/1984 | Brennan et al. | 501/32 |
| 4,564,059 | A | | 1/1986 | Dobatkin et al. | |
| 4,589,468 | A | * | 5/1986 | Misera et al. | 164/418 |
| 4,662,431 | A | * | 5/1987 | Lowry et al. | 164/503 |
| 4,699,636 | A | | 10/1987 | Bofinger et al. | |
| 4,770,699 | A | | 9/1988 | Mountford | |
| 4,802,436 | A | * | 2/1989 | Wilson et al. | 164/440 |
| 5,186,236 | A | | 2/1993 | Gabathuler et al. | |
| 5,198,187 | A | * | 3/1993 | Lu et al. | 419/35 |
| 5,333,844 | A | | 8/1994 | Holcombe et al. | |
| 5,340,379 | A | * | 8/1994 | Tremblay et al. | 75/680 |
| 5,372,634 | A | | 12/1994 | Monahan | |
| 5,443,892 | A | * | 8/1995 | Holcombe et al. | 428/216 |
| 5,527,381 | A | | 6/1996 | Waite et al. | |
| 5,604,301 | A | | 2/1997 | Mountford et al. | |
| 5,626,179 | A | | 5/1997 | Choudhury et al. | |
| 5,656,236 | A | | 8/1997 | Waite et al. | |
| 5,660,614 | A | | 8/1997 | Waite et al. | |
| 5,803,948 | A | | 9/1998 | Sizov et al. | |
| 5,810,037 | A | | 9/1998 | Sasaki et al. | |
| 5,934,900 | A | | 8/1999 | Billings | |
| 5,950,706 | A | | 9/1999 | Choudhury et al. | |
| 5,983,978 | A | | 11/1999 | Vining et al. | |
| 6,095,957 | A | * | 8/2000 | Ichino et al. | 492/54 |
| 6,132,532 | A | | 10/2000 | Shepelev et al. | |
| 6,177,755 | B1 | | 1/2001 | Hur | |
| 6,277,224 | B1 | | 8/2001 | Muesch et al. | |
| 6,604,941 | B2 | | 8/2003 | Billings | |
| 6,629,557 | B2 | | 10/2003 | Blucher et al. | |
| 6,676,381 | B2 | | 1/2004 | Subramanian et al. | |
| 6,705,385 | B2 | | 3/2004 | Ray et al. | |
| 6,776,214 | B2 | | 8/2004 | Ray et al. | |
| 6,799,626 | B2 | | 10/2004 | Ray et al. | |
| 6,811,602 | B2 | | 11/2004 | Beppu et al. | |
| 7,036,556 | B2 | | 5/2006 | Caputo et al. | |
| 7,297,238 | B2 | | 11/2007 | Nayar et al. | |
| 7,485,198 | B2 | | 2/2009 | Michaluk | |
| 7,540,995 | B2 | | 6/2009 | Furst et al. | |
| 7,582,133 | B2 | | 9/2009 | Kelly et al. | |
| 7,651,731 | B2 | | 1/2010 | Miranda | |
| 7,682,556 | B2 | | 3/2010 | Han et al. | |
| 7,731,823 | B2 | | 6/2010 | Nayar et al. | |
| 7,744,729 | B2 | | 6/2010 | Nayar et al. | |
| 7,790,101 | B2 | | 9/2010 | Kelly et al. | |
| 7,802,613 | B2 | | 9/2010 | Bullied et al. | |
| 8,574,336 | B2 | | 11/2013 | Rundquist et al. | |
| 8,652,397 | B2 | | 2/2014 | Rundquist et al. | |
| 2002/0083740 | A1 | | 7/2002 | Pandelisev | |
| 2003/0234173 | A1 | | 12/2003 | Minter | |
| 2004/0190733 | A1 | | 9/2004 | Nayar et al. | 381/98 |
| 2006/0024490 | A1 | | 2/2006 | Werner et al. | 428/323 |
| 2006/0127577 | A1 | | 6/2006 | Miranda et al. | 427/250 |
| 2006/0180293 | A1 | * | 8/2006 | Maehara et al. | 164/459 |
| 2007/0235159 | A1 | * | 10/2007 | Han et al. | 164/66.1 |
| 2008/0011442 | A1 | | 1/2008 | Pankl | |
| 2008/0156147 | A1 | | 7/2008 | Kelly et al. | |
| 2008/0156453 | A1 | * | 7/2008 | Kelly et al. | 164/412 |
| 2008/0196550 | A1 | | 8/2008 | Abe et al. | |
| 2008/0250863 | A1 | | 10/2008 | Moore | |
| 2009/0068434 | A1 | | 3/2009 | Michaluk | |
| 2009/0314390 | A1 | | 12/2009 | Gigliotti, Jr. et al. | |
| 2010/0264095 | A1 | | 10/2010 | Hadfield et al. | |
| 2011/0036467 | A1 | | 2/2011 | Stebbing | |
| 2011/0247456 | A1 | | 10/2011 | Rundquist et al. | |
| 2012/0042751 | A1 | | 2/2012 | Rundquist et al. | |
| 2014/0008848 | A1 | | 1/2014 | Rundquist et al. | |

FOREIGN PATENT DOCUMENTS

| | | | | |
|---|---|---|---|---|
| DE | 3905829 | | 4/1990 | |
| EP | 1 050 347 | | 11/2000 | |
| EP | 1 060 798 | | 12/2000 | |
| EP | 1 405 679 | | 4/2004 | |
| EP | 2 257 390 | | 1/2012 | |
| EP | 2 452 763 | | 5/2012 | |
| JP | 61-46368 | | 3/1986 | |
| JP | 1-127624 | | 5/1989 | |
| JP | 2-250745 | | 10/1990 | |
| JP | 4-110057 | | 4/1996 | |
| JP | 8-107899 | | 4/1996 | |
| JP | 11254095 | * | 9/1999 | B22D 11/04 |
| JP | O5318034 | * | 12/1999 | B22D 11/04 |
| JP | 00-77486 | | 9/2001 | |
| JP | 03-181378 | | 7/2003 | |
| JP | 03-266378 | | 9/2003 | |
| JP | 2005-199253 | | 7/2005 | |
| JP | 2006320945 | * | 11/2006 | B22D 11/59 |
| WO | WO 86/06749 | | 11/1986 | |
| WO | WO 97/27005 | | 1/1997 | |
| WO | WO 00/44959 | | 8/2000 | |
| WO | WO 01/36695 | | 5/2001 | |
| WO | WO 2005/052207 A2 | | 6/2005 | |
| WO | WO 2009/111536 A2 | | 9/2009 | |
| WO | WO 2012/054478 A1 | | 4/2012 | |

OTHER PUBLICATIONS

Metals Handbook, American Society of Metals, p. 1-44 to 1-53, Sep. 1992.

Partial International Search Report dated Jul. 8, 2009 cited in Application No. PCT/US2009/035983.

International Search Report dated Sep. 24, 2009 cited in Application No. PCT/US2009/035983.

European Communication dated Feb. 9, 2011 cited in Application No. 09 718 430.3-2213.

U.S. Appl. No. 13/082,437, filed Apr. 8, 2011 entitled "Ultrasonic Degassing of Molten Metals".

International Search Report dated Aug. 17, 2011 cited in Application No. PCT/US2011/031781.

U.S. Appl. No. 13/270,401, filed Oct. 11, 2011 entitled "Ultrasonic Device with Integrated Gas Delivery System".

European Search Report dated Apr. 13, 2012 cited in Application No. 11195036.6-2212.

U.S. Office Action dated Feb. 28, 2013 in U.S. Appl. No. 13/082,437, 27 pages.

Ohsawa, et al., Article entitled "Effects of Ultrasonic Vibration on Solidification Structures of Cast Iron" (1995) pp. 325-330.

Osawa et al., Paper entitled "Refining of Graphite Particles in Cast Irons by Applying Ultrasonic Vibration to Their Melts," National Research Institute for Metal, Japan, Processing and Fabrication of Advanced Materials VI, The Institute of Materials 1998, pp. 15-22.

Abramov, O. V., entitled "Ultrasound in Liquid and Solid Metals," Ultrasonics Research and Development, The Institute of General and Inorganic Chemistry, Russian Academy of Sciences, Moscow, Russia (1994), cover, index and pp. 30-34.

Notification for the Grant of Inventor Patent Right and the Notification for Completion of Formalities for Registration dated Nov. 5, 2012, 4 pages.

Shimada et al, entitled "A Kinetic Study on Oxidation of Niobium Carbide," 1993 Elsevier Science Publishers B.V., Solid State Ionics 63-65 (1993) pp. 312-317.

Shimada et al., Article entitled "A Kinetic Study on Oxidation of Niobium Carbide," published in the 1993 Elsevier Science Publishers B.V., Solid State Ionics 63-65 (1993) pp. 312-317.

Notice of Allowance dated Jun. 13, 2013 cited in U.S. Appl. No. 13/082,437, 7 pages.

(56) References Cited

OTHER PUBLICATIONS

U.S. Office Action dated Jun. 27, 2013 cited in U.S. Appl. No. 13/270,401, 28 pages.

International Search Report dated Aug. 30, 2013 cited in Application No. PCT/US2012/059529, 14 pages.

Chinese Office Action dated Sep. 13, 2013 in Chinese Application Serial No. 201180028126.4.

* cited by examiner

NIOBIUM AS A PROTECTIVE BARRIER IN MOLTEN METALS

REFERENCE TO RELATED APPLICATION

This application claims the benefit of U.S. Provisional Application Ser. No. 61/033,807, filed on Mar. 5, 2008, the disclosure of which is incorporated herein by reference in its entirety.

COPYRIGHTS

All rights, including copyrights, in the material included herein are vested in and the property of the Applicants. The Applicants retain and reserve all rights in the material included herein, and grant permission to reproduce the material only in connection with reproduction of the granted patent and for no other purpose.

BACKGROUND

The processing or casting of copper articles may require a bath containing molten copper, and this bath of molten copper may be maintained at temperatures of around 1100° C. Many instruments or devices may be used to monitor or to test the conditions of the molten copper in the bath, as well as for the final production or casting of the desired copper article. There is a need for these instruments or devices to better withstand the elevated temperatures encountered in the molten copper bath, beneficially having a longer lifetime and limited to no reactivity with molten copper.

SUMMARY

This summary is provided to introduce a selection of concepts in a simplified form that are further described below in the detailed description. This summary is not intended to identify key features or essential features of the claimed subject matter. Nor is this summary intended to be used to limit the claimed subject matter's scope.

Devices may be in contact with molten metals such as copper, for example. The devices may include, but are not limited to, a die used for producing articles made from the molten metal, a sensor for determining an amount of a dissolved gas in the molten metal, or an ultrasonic device for reducing gas content (e.g., hydrogen) in the molten metal. Niobium may be used as a protective barrier for the devices when they are exposed to the molten metals.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1:
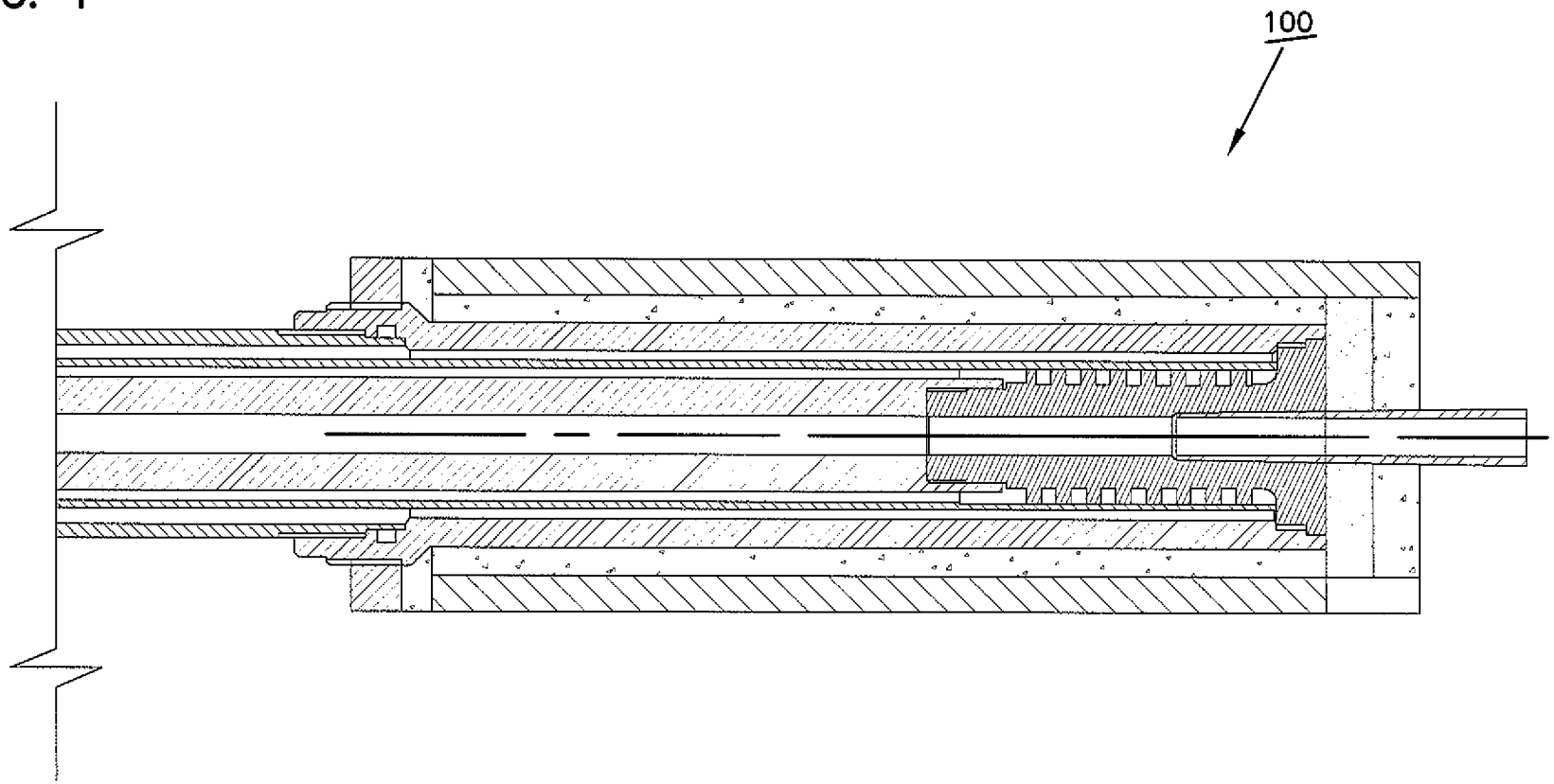
FIG. 1 shows a partial cross-sectional view of a die.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

Embodiments of the present invention may provide systems and methods for increasing the life of components directly in contact with molten metals. For example, embodiments of the invention may use niobium to reduce degradation of materials in contact with molten metals resulting in significant quality improvements in end products. In other words, embodiments of the invention may increase the life of or preserve materials or components in contact with molten metals by using niobium as a protective barrier. Niobium may have properties, for example its high melting point, that may help provide the aforementioned embodiments of the invention. In addition, niobium may also form a protective oxide barrier when exposed to temperatures of 200° C. and above.

Moreover, embodiments of the invention may provide systems and methods for increasing the life of components directly in contact or interfacing with molten metals. Because niobium has low reactivity with molten metals, using niobium may prevent a substrate material from degrading. The quality of materials in contact with molten metals may decrease the quality of the end product. Consequently, embodiments of the invention may use niobium to reduce degradation of substrate materials resulting in significant quality improvements in end products. Accordingly, niobium in association with molten metals may combine niobium's high melting point and low reactivity with molten metals such as copper.

Embodiments consistent with the invention may include a die comprising graphite and niobium. Such a die may be used in the vertical casting of copper articles from a bath comprising molten copper. For instance, the die may comprise an inner layer and an outer layer, wherein the outer layer may be configured to cause heat to be transferred from molten metal, such as molten copper, into a surrounding atmosphere. The inner layer may be configured to provide a barrier, such as an oxygen barrier, for the outer layer. The inner layer may comprise niobium and the outer layer may comprise graphite. The niobium inner layer may be the layer in direct contact with the molten metal, for example, in contact with molten copper. The thickness of the inner layer comprising niobium may be important for both the thermal conductivity and ultimate function of the die as well as for the barrier that the niobium provides over the graphite and the resultant ultimate lifetime of the die. For instance, the lifetime of a graphite die without niobium may be about 3 days, while the lifetime of a die comprising graphite and a niobium layer in direct contact with the molten copper may be about 15 to about 20 days. In some embodiments, the thickness of the inner layer comprising niobium may less than about 10 microns, such as in a range from about 1 to about 10 microns. The thickness of the inner layer comprising niobium may be in a range from about 2 to about 8 microns, or from about 3 to about 6 microns, in other embodiments of the invention.

Consistent with embodiments of the invention, niobium may be used as a coating on dies that are used in the vertical copper casting. The die opening may be generally cylindrical in shape, but this is not a requirement. The following stages in vertical copper casting may include the following. First, a vertical graphite die encased in a cooling jacket may be immersed into a molten copper bath. The die may be exposed to a temperature of approximately 1100° C. Because graphite may have excellent thermal conductivity, the graphite in the die may cause heat to be transferred from the molten copper into the surrounding atmosphere. Through this cooling process, molten copper may be converted to solid copper rod. The aforementioned graphite die, however, may have high reactivity with oxygen (that may be present in molten copper) leading to die degradation. Consequently, graphite dies may need to be periodically replaced to meet copper rod quality requirements. This in turn may lead to higher production and quality costs.

FIG. 1 illustrates using niobium as a barrier coating in, for example, graphite dies. As illustrated by FIG. 1, embodiments of the inventions may provide a die 100 that may utilize the higher melting point of niobium and its low reactivity with molten copper to increase the life of the die 100 over a conventional graphite die. For example, embodiments of the inventions may use a niobium coating over graphite portions of the die 100. The niobium may be in direct contact with molten copper. The niobium coating may reduce or prevent oxygen from penetrating into the graphite, thus increasing the life of the die 100. This in turn may lead to decreases in production costs and increases in quality. Consistent with embodiments of the invention, the niobium coating may be very thin and still act as a barrier to oxygen without reacting with molten copper and additionally with little or no changes in the thermal characteristics of the die 100 over a conventional graphite die. In other words, a sufficient thickness of the niobium coating may be chosen to provide the aforementioned oxygen barrier, yet still be thin enough to allow the die 100 to cause heat to be transferred from the molten copper into the surrounding atmosphere.

Consistent with this embodiment is a method for producing a solid article comprising copper from molten copper. This method may comprise providing a bath comprising molten copper, introducing molten copper from the bath into an entrance of the die 100, and processing the molten copper through the die 100 while cooling to produce the solid article comprising copper at an exit of the die 100. Articles of manufacture can be produced by this method, and such articles are also part of this invention. For instance, the article can be a rod comprising copper.

In other embodiments, niobium may be used in a sensor for determining an amount of a dissolved gas in a bath comprising molten copper. For instance, the sensor may comprise a sensor body surrounding a portion of a solid electrolyte tube, and a reference electrode contained within the solid electrolyte tube. The solid electrolyte tube may comprise a first end and a second end. The first end of the solid electrolyte tube may be positioned within the sensor body and the second end may comprise a tip which extends outwardly from the sensor body. In accordance with this embodiment, the tip of the solid electrolyte tube may comprise niobium. The bath comprising molten copper may contain a dissolved gas, which may be, for example, oxygen, hydrogen, or sulfur dioxide, or a combination of these materials. The sensor may be employed to measure the amount of the dissolved gas in the bath of molten copper on a continuous basis or, alternatively, may be used for isolated or periodic testing of the amount of the respective dissolved gas at certain pre-determined time intervals.

Figure 2:
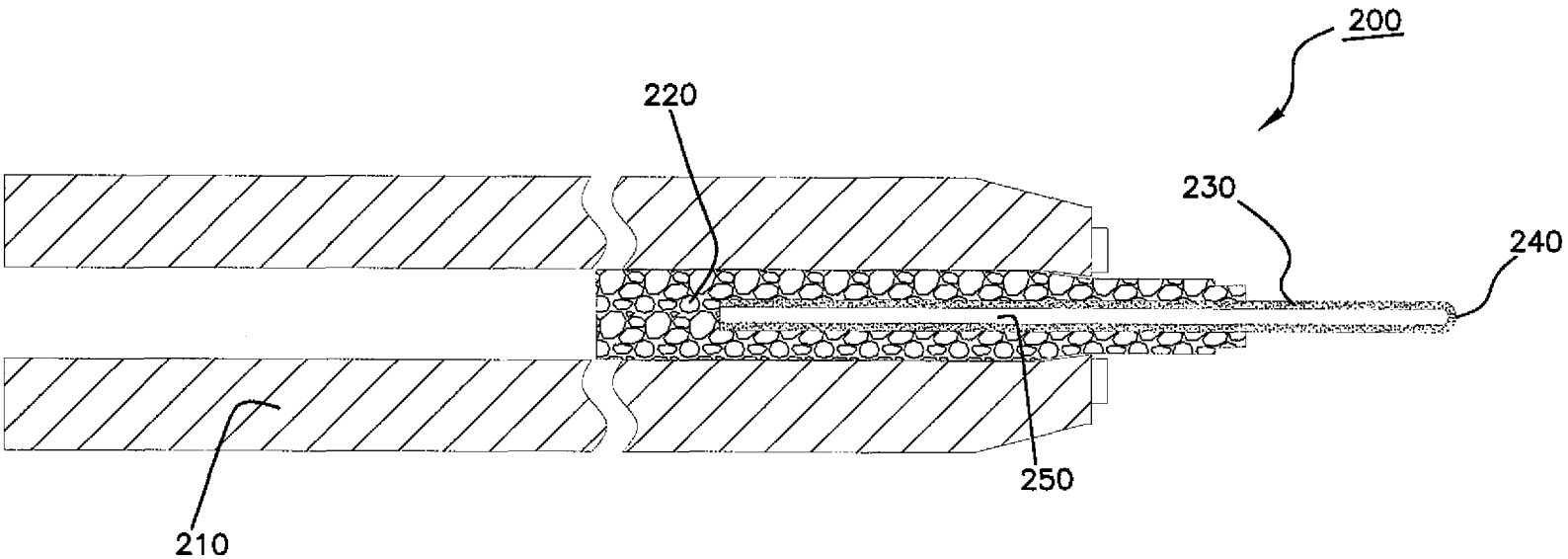
FIG. 2 shows a partial cross-sectional view of a sensor.

FIG. 2 illustrates using niobium as a material for a sensor 200 for continuously measuring the amount of oxygen in a bath comprising a molten metal comprising, but not limited to, copper. Knowing the oxygen content in molten copper may be useful during the copper casting process. Too much or too little oxygen may have detrimental effects on the article or casting when the copper solidifies. For instance, oxygen contents in molten copper within a range from about 150 ppm to about 400 ppm, or from about 175 ppm to about 375 ppm, may be beneficial in the copper casting process. While the sensor may measure the amount of dissolved oxygen in the 150-400 ppm range, it may be expected that the sensor has a detection range of measurable oxygen contents from as low as about 50 ppm of oxygen to as high as about 1000 ppm or more.

The oxygen sensor 200 of FIG. 2 may include a reference electrode 250 housed or contained within a solid electrolyte tube 230. The reference electrode 250 may be a metal/metal-oxide mixture, such as $Cr/Cr_2O_3$, which may establish a reference value of oxygen partial pressure. A portion of the solid electrolyte tube 230 may be surrounded by an insulating material 220. The insulating material 220 may contain particles of alumina ($Al_2O_3$) or other similar insulative material. The solid electrolyte tube 230 and insulating material 220 may be surrounded by a sensor body 210. The sensor body 210 may be constructed of many suitable materials including, but not limited to, metals, ceramics, or plastics. Combinations of these materials also may be utilized in the sensor body 210. The sensor body 210 may be generally cylindrical in shape, but this is not a requirement.

The sensor body 210 may, in certain embodiments, surround only a portion of the solid electrolyte tube 230. For example, the solid electrolyte tube 230 may comprise a first end and a second end. The first end of the solid electrolyte tube 230 may be positioned within the sensor body and the second end may comprise a tip 240 which may extend outwardly from the sensor body 210. Consistent with certain embodiments of this invention, the tip 240 of the solid electrolyte tube 230 may be placed in the bath comprising molten copper to determine the dissolved oxygen content.

The solid electrolyte tube 230, the tip 240, or both, may comprise niobium. Niobium may be alloyed with one or more other metals, or niobium may be a layer that is plated or coated onto a base layer of another material. For instance, the solid electrolyte tube 230, the tip 240, or both, may comprise an inner layer and an outer layer, wherein the inner layer may comprise a ceramic or a metal material and the outer layer may comprise niobium. It may be expected that the presence of niobium in the solid electrolyte tube 230, the tip 240, or both, may provide good electrical conductivity, strength at the melting temperature of copper, and resistance to chemical erosion by the molten copper. Niobium may provide embodiments of the invention with the aforementioned characteristics along with the ease of machining and fabrication. Not shown in FIG. 2, but encompassed herein, is a sensor output or readout device which displays the measured oxygen content based on an electrical signal generated from the sensor 200. The output or readout device may be physically connected to the sensor 200 or connected wirelessly.

Consistent with this embodiment is a method for measuring an amount of a dissolved gas in a bath comprising molten copper. Such a method may comprise inserting the tip 240 of the sensor 200 into the bath comprising molten copper, and determining from a generated electrical signal the amount of the dissolved gas in the bath comprising molten copper. Often, the dissolved gas being measured is oxygen. The amount of oxygen dissolved in the bath comprising molten copper may be in a range from about 50 ppm to about 1000 ppm, for example, from about 150 ppm to about 400 ppm.

In other embodiments, niobium may be used in an ultrasonic device comprising an ultrasonic transducer and an elongated probe. The elongated probe may comprise a first end and a second end, wherein the first end may be attached to the ultrasonic transducer and the second end may comprise a tip. In accordance with this embodiment, the tip of the elongated probe may comprise niobium. The ultrasonic device may be used in an ultrasonic degassing process. A bath of molten copper, which may be used in the production of copper rod, may contain a dissolved gas, such as hydrogen. Dissolved hydrogen over 3 ppm may have detrimental effects on the casting rates and quality of the copper rod. For example, hydrogen levels in molten copper of about 4 ppm, about 5 ppm, about 6 ppm, about 7 ppm, or about 8 ppm, and above, may be detrimental. Hydrogen may enter the molten copper bath by its presence in the atmosphere above the bath containing molten copper, or it may be present in copper feedstock starting material used in the molten copper bath. One method to remove hydrogen from molten copper is to use ultrasonic vibration. Equipment used in the ultrasonic vibration process may include a transducer that generates ultrasonic waves. Attached to the transducer may be a probe that transmits the ultrasonic waves into the bath comprising molten copper. By operating the ultrasonic device in the bath comprising molten copper, the hydrogen content may be reduced to less than about 3 ppm, such as, for example, to within a range from about 2 ppm to about 3 ppm, or to less than about 2 ppm.

Figure 3:
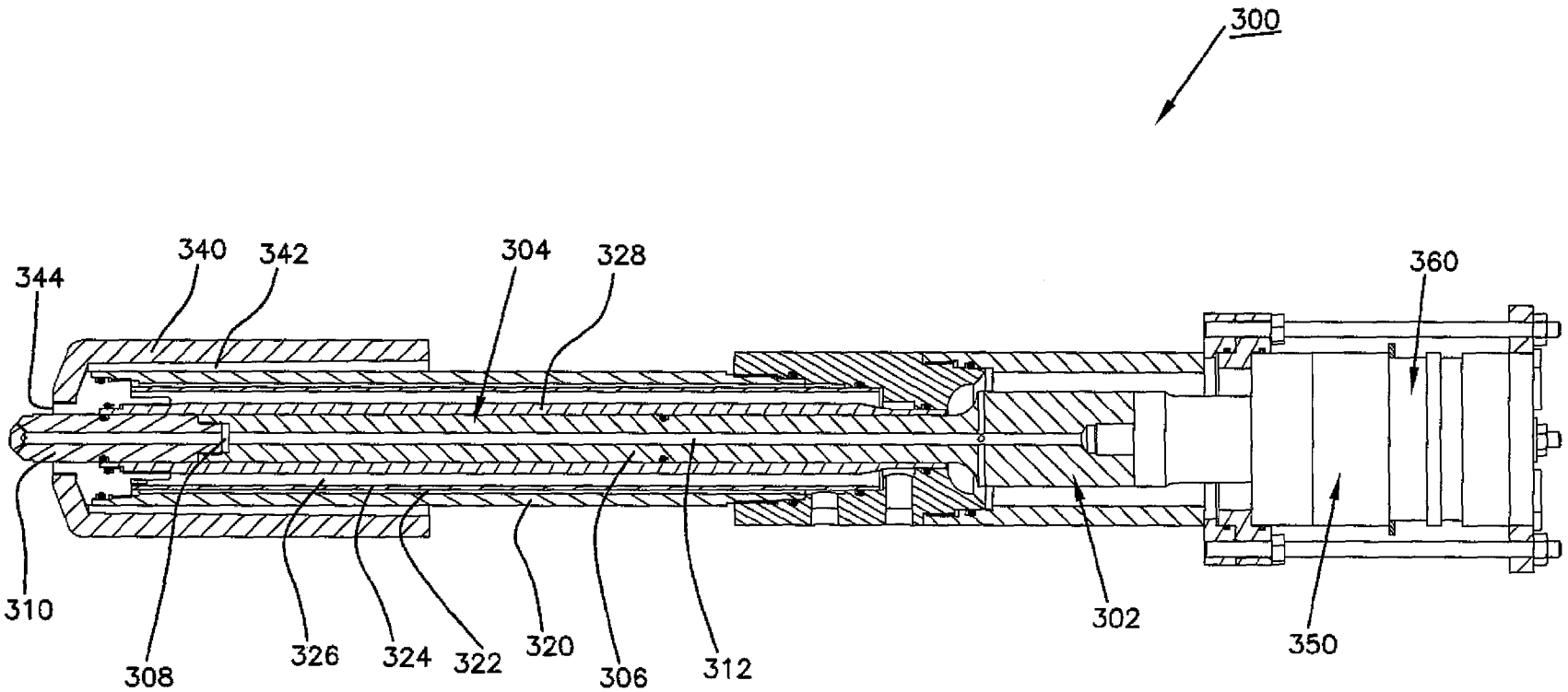
FIG. 3 shows a partial cross-sectional view of an ultrasonic device.

FIG. 3 illustrates using niobium as a material in an ultrasonic device 300, which may be used to reduce the hydrogen content in molten copper. The ultrasonic device 300 may include an ultrasonic transducer 360, a booster 350 for increased output, and an ultrasonic probe assembly 302 attached to the transducer 360. The ultrasonic probe assembly 302 may comprise an elongated ultrasonic probe 304 and an ultrasonic medium 312. The ultrasonic device 300 and ultrasonic probe 304 may be generally cylindrical in shape, but this is not a requirement. The ultrasonic probe 304 may comprise a first end and a second end, wherein the first end comprises an ultrasonic probe shaft 306 which is attached to the ultrasonic transducer 360. The ultrasonic probe 304 and the ultrasonic probe shaft 306 may be constructed of various materials. Exemplary materials may include, but are not limited to, stainless steel, titanium, and the like, or combinations thereof. The second end of the ultrasonic probe 304 may comprise an ultrasonic probe tip 310. The ultrasonic probe tip 310 may comprise niobium. Alternatively, the tip 310 may consistent essentially of, or consist of, niobium. Niobium may be alloyed with one or more other metals, or niobium may be a layer that is plated or coated onto a base layer of another material. For instance, the tip 310 may comprise an inner layer and an outer layer, wherein the inner layer may comprise a ceramic or a metal material (e.g., titanium) and the outer layer may comprise niobium. In this embodiment, the thickness of the outer layer comprising niobium may be less than about 10 microns, or alternatively, within a range from about 2 to about 8 microns. For example, the thickness of the outer layer comprising niobium may be in range from about 3 to about 6 microns.

The ultrasonic probe shaft 306 and the ultrasonic probe tip 310 may be joined by a connector 308. The connector 308 may represent a means for attaching the shaft 306 and the tip 310. For example the shaft 306 and the tip 310 may be bolted or soldered together. In one embodiment, the connector 308 may represent that the shaft 306 contains recessed threading and the tip 310 may be screwed into the shaft 306. It is contemplated that the ultrasonic probe shaft 306 and the ultrasonic probe tip 310 may comprise different materials. For instance, the ultrasonic probe shaft 306 may comprise titanium, and the ultrasonic probe tip 310 may comprise niobium.

Referring again to FIG. 3, the ultrasonic device 300 may comprise an inner tube 328, a center tube 324, an outer tube 320, and a protection tube 340. These tubes may surround at least a portion of the ultrasonic probe 304 and generally may be constructed of any suitable metal material. It may be expected that the ultrasonic probe tip 310 will be placed into the bath of molten copper; however, it is contemplated that a portion of the protection tube 340 also may be immersed in molten copper. Accordingly, the protection tube 340 may comprise titanium, niobium, silicon carbide, or a combination of more than one of these materials. Contained within the tubes 328, 324, 320, and 340 may be fluids 322, 326, and 342, as illustrated in FIG. 3. The fluid may be a liquid or a gas (e.g., argon), the purpose of which may be to provide cooling to the ultrasonic device 300 and, in particular, to the ultrasonic probe tip 310 and the protection tube 340.

The ultrasonic device 300 may comprise an end cap 344. The end cap may bridge the gap between the protection tube 340 and the probe tip 310 and may reduce or prevent molten copper from entering the ultrasonic device 300. Similar to the protection tube 340, the end cap 344 may be constructed of, for example, titanium, niobium, silicon carbide, or a combination of more than one of these materials.

The ultrasonic probe tip 310, the protection tube 340, or the end cap 344, or all three, may comprise niobium. Niobium may be alloyed with one or more other metals, or niobium may be a layer that is plated or coated onto a base layer of another material. For instance, the ultrasonic probe tip 310, the protection tube 340, or the end cap 344, or all three, may comprise an inner layer and an outer layer, wherein the inner layer may comprise a ceramic or a metal material and the outer layer may comprise niobium. It may be expected that the presence of niobium on parts of the ultrasonic device may improve the life of the device, provide low or no chemical reactivity when in contact with molten copper, provide strength at the melting temperature of copper, and have the capability to propagate ultrasonic waves.

Embodiments of the invention may include a method for reducing hydrogen content in a bath comprising molten copper. Such a method may comprise inserting the tip 310 of the ultrasonic device 300 into the bath comprising molten copper, and operating the ultrasonic device 300 at a predetermined frequency, wherein operating the ultrasonic device 300 reduces the hydrogen content in the bath comprising molten copper. Often, there is greater than 3 ppm, greater than 4 ppm, greater than 5 ppm, or greater than 6 ppm, of dissolved hydrogen in the molten copper prior to operating the ultrasonic device 300. For example, the hydrogen content in the bath comprising molten copper may be in a range from about 4 to about 6 ppm of hydrogen. The result of this ultrasonic degassing method may be a reduction in the hydrogen content in the bath comprising molten copper to a level that is less than about 3 ppm, or alternatively, less than about 2 ppm.

Consistent with embodiments of the invention, using niobium may address the needs listed above. Niobium may have characteristics as shown in Table 1 below.

TABLE 1

| | |
|---|---|
| Wrought Tensile Strength | 585 Mega Pascals |
| Wrought Hardness | 160 HV |
| Elastic Modulus | 103 Giga Pascals |
| Shear Modulus | 37.5 Giga Pascals |

TABLE 1-continued

| | |
|---|---|
| Melting point | 2750 K (2477° C., 4491° F.) |
| Symbol, Number | Nb, 41 |
| Atomic weight | 92.91 g/mol |
| Density | 8.57 g/cc |
| Thermal conductivity | (300 K) 53.7 W/m-k |
| Thermal expansion | (25° C.) 7.3 μm/m-k |

While certain embodiments of the invention have been described, other embodiments may exist. Further, any disclosed methods' stages may be modified in any manner, including by reordering stages and/or inserting or deleting stages, without departing from the invention. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

What is claimed is:

1. A die having an entrance on one side and an exit on another side, the die comprising:

an outer layer configured to cause heat to be transferred from molten metal into a surrounding atmosphere such that the die is configured to form a solid article from the molten metal; and an inner layer configured to provide an oxygen barrier for the outer layer, wherein the inner layer is configured to provide the oxygen barrier for the outer layer when the die is exposed to a temperature of about 1100° C., and wherein the inner layer comprises elemental niobium;

wherein the outer layer comprises graphite; and wherein a thickness of the inner layer is less than about 10 microns.

2. A die having an entrance on one side and an exit on another side, the die configured for efficient heat transfer and increased die lifetime, the die comprising:

an outer layer comprising graphite and configured to cause heat to be transferred from molten metal into a surrounding atmosphere such that the die is configured to form a solid article from the molten metal; and an inner layer comprising elemental niobium, the inner layer having a thickness in a range from about 1 to about 10 microns.

3. The die of claim 2, wherein the thickness of the inner layer comprising elemental niobium is in a range from about 3 to about 6 microns.

4. The die of claim 1, wherein the thickness of the inner layer comprising elemental niobium is in a range from about 1 to about 4 microns.

5. The die of claim 2, wherein the thickness of the inner layer comprising elemental niobium is in a range from about 1 to about 3 microns.

6. A die having an entrance on one side and an exit on another side, the die comprising:

graphite portions, the graphite portions configured to cause heat to be transferred from molten metal into a surrounding atmosphere such that the die is configured to form a solid article from the molten metal; and a coating comprising elemental niobium over the graphite portions, the coating having a thickness in a range from about 1 to about 10 microns.

7. The die of claim 6, wherein the thickness of the coating comprising elemental niobium is in a range from about 2 to about 8 microns.

8. The die of claim 6, wherein the thickness of the coating comprising elemental niobium is in a range from about 3 to about 6 microns.

9. The die of claim 6, wherein the thickness of the coating comprising elemental niobium is in a range from about 1 to about 4 microns.

10. A die having an entrance on one side and an exit on another side, the die configured to form solid articles from molten metals, the die comprising:

an outer layer comprising graphite; and an inner layer comprising elemental niobium, the inner layer having a thickness in a range from about 2 to about 8 microns.

* * * * *